United States Patent [19]

Branson

[11] Patent Number: 4,902,140

[45] Date of Patent: Feb. 20, 1990

[54] DETACHABLE HANDLE FOR SHIPPING SACKS

[75] Inventor: Mark E. Branson, Shelbyville, Ind.

[73] Assignee: KCL Corporation, Shelbyville, Ind.

[21] Appl. No.: 334,696

[22] Filed: Apr. 6, 1989

[51] Int. Cl.[4] ..... B65D 33/08

[52] U.S. Cl. ..... 383/25; 383/61; 383/63; 383/79; 383/92; 206/618

[58] Field of Search ..... 383/25, 29, 61, 63, 383/79, 81, 78, 92, 13, 30, 31; 206/610, 618, 632

[56] References Cited

U.S. PATENT DOCUMENTS

| | | | |
|---|---|---|---|
| 1,951,599 | 3/1934 | Dever | 383/92 |
| 2,050,967 | 8/1936 | Farmer | 383/29 |
| 2,608,227 | 8/1952 | Witt | 383/29 |
| 2,625,318 | 1/1953 | Ross | 383/79 |
| 2,947,464 | 8/1960 | Newton | 383/25 |
| 2,978,164 | 4/1961 | Williams et al. | 383/81 |
| 2,979,253 | 4/1961 | Phillips et al. | 383/79 |
| 3,030,003 | 4/1962 | Schanzle | 383/79 |
| 3,099,384 | 7/1963 | Baxter | 383/25 |
| 3,228,585 | 1/1966 | Fleming | 383/92 |
| 4,241,865 | 12/1980 | Ferrell | 383/61 |
| 4,620,320 | 10/1986 | Sullivan | 383/61 |
| 4,691,370 | 9/1987 | MacFee | 383/61 |

FOREIGN PATENT DOCUMENTS

| | | | |
|---|---|---|---|
| 1406639 | 6/1965 | France | 383/29 |
| 0697659 | 11/1965 | Italy | 383/92 |
| 0799284 | 8/1958 | United Kingdom | 206/610 |
| 2070562 | 9/1981 | United Kingdom | 383/81 |

OTHER PUBLICATIONS

"Rip Strip, Open Zip", Feb. 1985, "Packaging", vol. 30, No. 2, p. 13.

*Primary Examiner*—Stephen Marcus
*Assistant Examiner*—K. M. Stemann
*Attorney, Agent, or Firm*—Woodard, Emhardt, Naughton, Moriarty & McNett

[57] ABSTRACT

A shipping sack having side walls defining a mouth from which contents may be discharged, includes a non-reclosable stitched fastener across and closing the mouth. The stitched fastener includes a removable chain stitch and a removable rip tape for facilitating manual opening of the stitched fastener. The rip tape is composed of a strip having a cut-out opening therethrough defining a handle adapted to be manually grasped for carry the shipping sack. The rip tape also includes a free end extending beyond the edge of the shipping sack to facilitate manual access to the rip tape and to facilitate pulling the rip tape to remove the stitched fastener.

5 Claims, 2 Drawing Sheets

DETACHABLE HANDLE FOR SHIPPING SACKS

BACKGROUND OF THE INVENTION

This invention relates to the art of shipping sacks, and more particularly to sacks having a non-reclosable closure fastener and a handle for carrying the sack.

Shipping sacks are frequently used for carrying heavy, bulky goods, such as dog food, charcoal, cat litter and detergent, which ordinarily require packaging which will withstand in excess of fifteen pounds contents weight. For this type of goods, the sacks are frequently provided with a carrying handle at the top of the sack to facilitate carrying the full sack. One type of sack known in the art includes a separate rigid plastic handle that is sewn onto the top of the sack with a non-reclosable, separable closure fastener, such as a chain stitch, that is used to close the top of the sack. One difficulty with handles of this type is that the separate plastic handle is usually hand fed and supported during the operation in which the chain stitch is sewn onto the sack. Not only is this type of operation labor intensive, it is also inaccurate, resulting in handles that are not completely attached to the sack.

SUMMARY OF THE INVENTION

A primary aim of the present invention is to overcome the disadvantages and inefficiencies of the prior handles attached to shipping sacks for bulky products. An important object of the invention is to provide a new and improved detachable handle for the shipping sacks that is readily and easily attached to the sack with the non-reclosable, separable closure fastener. Another object of the invention is to provide a detachable handle for shipping sacks that can be attached to the shipping sack in a continuous operation, requiring little or no manual intervention.

These and other objects of the invention are addressed by the provision of a rip tape that extends across the width of the shipping sack to which the tape is to be attached. The rip tape includes an upper peripheral attachment portion that is sewn together with the upper ends of the walls of the shipping sack. The rip tape also includes a handle cut-out opening beneath the peripheral attachment portion that is adapted to be manually grasped. The rip tape not only provides a means for carrying the filled shipping sack, it also is usable as a tear-strip to facilitate the removal of the non-reclosable, separable closure fastener, thereby providing access to the contents of the shipping sack. Other objects, features and advantages of the invention will be readily apparent from the following description and accompanying figures.

DESCRIPTION OF THE PREFERRED EMBODIMENT

Figure 1:
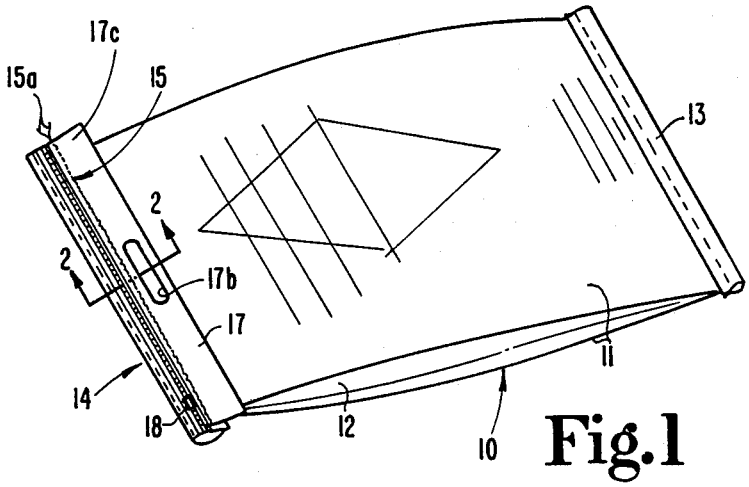
FIG. 1 is a perspective view of a shipping sack embodying the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A shipping sack 10 of customary design comprises front and back face walls 11 with opposite sidewalls 12 and a fixed bottom closure 13 for sealing the bottom edge of the walls 11. The bottom closure 13 may comprise any typical structure, such as the ends of the back walls 11 turned over and adhesively secured, a folded closure strip adhesively secured or stitched in place, or the like. It is understood that sacks of this kind are generally closed at their upper ends, and the lower ends of the sacks remain open until the sacks are filled through the opened lower ends, which are then closed to seal the contents within the sack.

Figure 2:
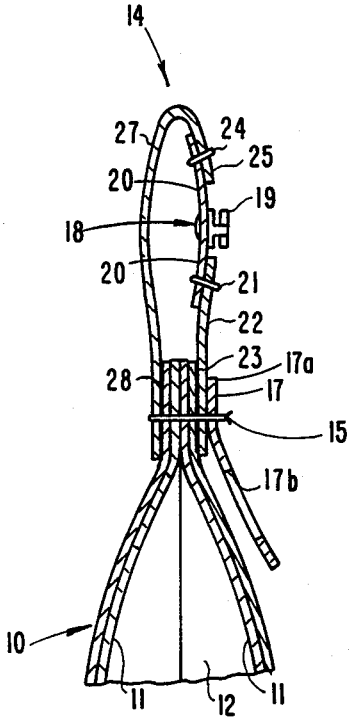
FIG. 2 is an enlarged fragmentary sectional view taken along line 2—2 of FIG. 1.

The sack 10 includes a top closure 14 which, in the preferred embodiment, includes a non-reclosable, separable fastener 15 and a secondary reclosable fastener 18. In one embodiment of the invention, the secondary reclosable fastener 18 comprises a zipper assembly 19 that is carried on a zipper tape 20, as illustrated in FIG. 2. The zipper tape 20 is secured, such as by double chain stitching 21 and 24, to a pair of strips 22 and 27. The bottom ends of the strips 22 and 27 are secured to the walls 11 of the sack by means of adhesive 23 and 28. The secondary reclosable zipper fastener 18 of the present embodiment is identical in its construction and operation to the fastener disclosed in the patent to Ferrell, U. S. No. 4,241,865, assigned to the assignee of the present application, the subject matter of which is incorporated herein by reference.

The non-reclosable fastener 15 consists of a separable stitched fastener or chain stitch. The chain stitch of the stitched fastener 15 is stitched across and closes the upper end or mouth of the sack 10. The chain stitch 15 is adapted to be removed or unraveled by pulling the ends 15a of the chain stitch. However, the chain stitch is sufficiently strong to keep the mouth of the sack sealed, even when the contents of the sack are shifted during handling.

Figure 2A:
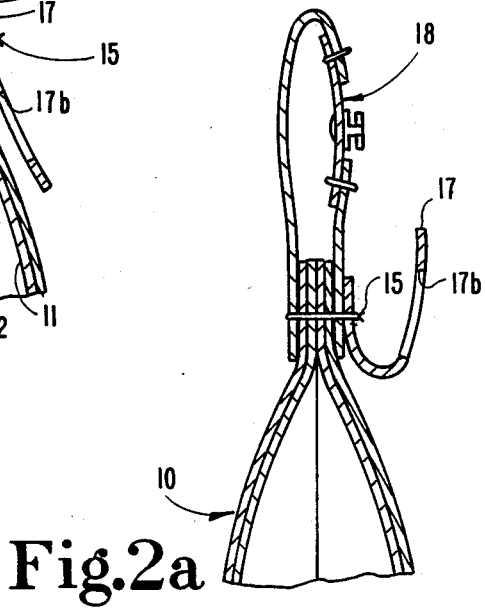
FIG. 2*a* is an enlarged fragmentary sectional of the shipping sack of FIG. 2 shown with the rip tape provided as a carrying handle.

In order to facilitate the removal of the non-reclosable, separable fastener 15, a rip tape or tear-strip 17 is provided. The rip tape 17 is stitched onto the wall 11 of the sack by means of the chain stitch 15. The rip tape 17 is used to facilitate removal of the chain stitching by providing a wider strip to grasp and pull. In the prior art, the rip tape has typically been a uniform strip composed of crepe paper. In a novel deviation from the prior art, the present invention provides an upper peripheral attachment portion 17*a*, through which the chain stitch fastener 15 is sewn, and a cut-out opening 17*b* defining a handle below the chain stitch fastener. The handle cut-out opening 17*b* is configured to provide a manual hand-hold formed in the rip tape 17 to facilitate carrying the shipping sack 10. In its use as a handle, the rip tape 17 is bent upwards over the chain stitch 15, as shown in FIG. 2*a*. The rip tape may comprise a wider strip so that the handle cut-out opening extends above the secondary closure fastener. In this instance, a second rip tape may be provided at the other of the sack walls 11 so that the handles overlap the top of the sack 10. The rip tape also includes a free end portion 17*c* which extends slightly beyond the side edges of the sack walls 11, as shown in FIG. 1. This free end portion 17*c* is readily accessible and easy to grasp for pulling the rip tape to separate or unravel the chain stitch.

Figure 3:
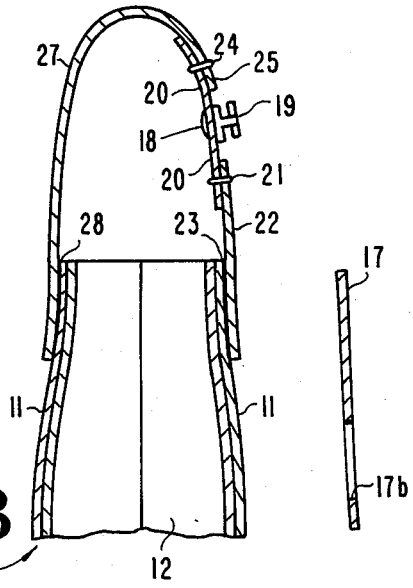
FIG. 3 is a fragmentary sectional view showing the stitched fastener opened and the detachable handle removed.

As shown in FIG. 3, the mouth of the shipping sack 10 is opened when the non-reclosable, separable chain stitch fastener 15 is removed. At the same time, the chain stitch is removed, the rip tape 17 including the handle 17*b* is also removed and may be discarded by the consumer, since the handle is no longer necessary for transporting the product from the point of sale to the consumer's home. Thus, it is seen that the rip tape 17 serves two functions—one as a means for facilitating removal of the chain stitch fastener 15 and another as means for transporting the sack when filled with a product.

Figure 4:
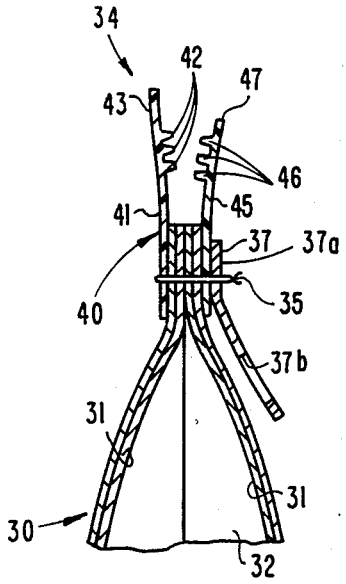
FIG. 4 is an enlarged fragmentary sectional view similar to the view of FIG. 2, but showing a different secondary reclosable closure fastener.
Figure 5:
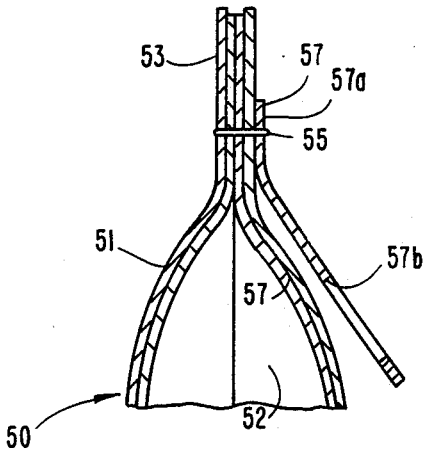
FIG. 5 is an enlarged sectional view similar to FIG. 2, but showing a shipping sack having no secondary reclosable closure fastener.

Alternative embodiments of the present invention are shown in FIGS. 4 and 5. In FIG. 4, a shipping sack 30 includes a top closure 34 having the non-reclosable chain stitch fastener 35 and a secondary reclosable fastener 40, each attached across and closing the upper end of the sack 30. The secondary reclosable fastener 40 includes a pair of opposing profile strips 41 and 45. Each of the profile strips includes a number of interlocking ribs 42 and 46, respectively. The profile strips 41 and 45 also include a pair of flanges 43 and 47 at the top of the respective strips to facilitate separation of the interlocking ribs. The profile fastener strips of the embodiment of FIG. 4 is the subject of a co-pending application assigned to the assignee of the present invention. In this embodiment, a handle rip tape 37 is removably attached to the sack 30 at its upper attachment peripheral portion 37A by the chain stitching 35. The handle cut-out opening 37B extends below the chain stitching, but can be folded upwards to facilitate carrying the shipping sack as with the previous embodiment.

In the embodiment of FIG. 5, a shipping sack 50 includes an upper peripheral portion 53 where the sack walls 51 are joined only by the non-reclosable stitched fastener 55. A handle rip tape 57 is sewn onto the sack 50 by way of the chain stitching 55 at the upper peripheral attachment portion 57A of the tape. The handle cut-out opening 57B extends below the chain stitching in the manner described above.

Figure 6:
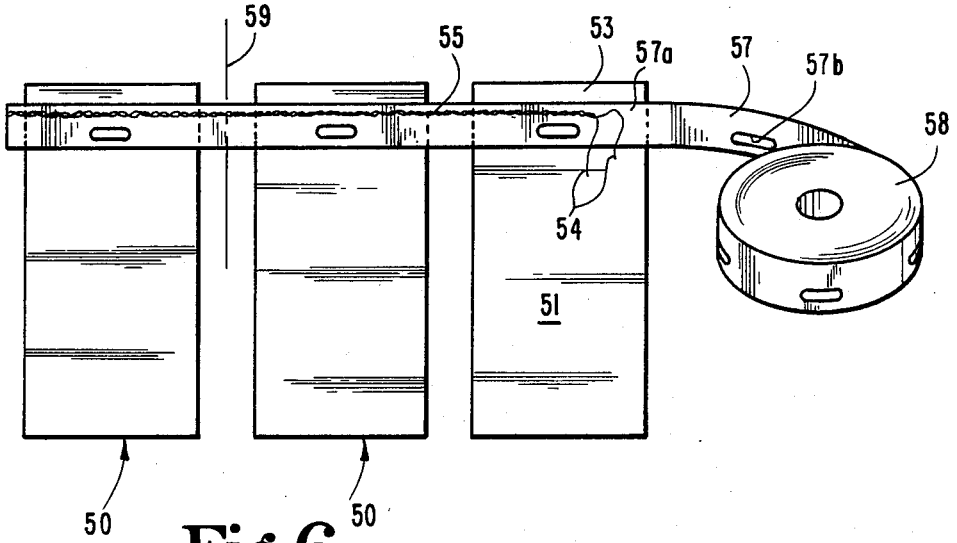
FIG. 6 is a schematic illustration of steps in the method of making the shipping sack of the present invention having the detachable rip tape, in which the shipping sack is similar to that shown in FIG. 5.

The rip tape handle of the present invention overcomes a primary difficulty with the rigid plastic handles of the prior art in that the handle rip tape may be attached to the shipping sack in a continuous process with almost no human intervention. In the method of manufacturing the shipping sack of the present invention, a succession of tubular collapsed, flattened sacks, such as the sack 50 shown in the embodiment of FIG. 5, is moved along a production line with the sackes aligned in a parallel spaced apart relation, substantially as shown in FIG. 6. The handle rip tape 57 is continuously supplied from a reel 58. Cord or thread 54 is provided from a separate spool source (not shown) and is continuously sewn by conventional means into the chain stitch 55 onto one wall 51 at the open end of the sack. The sacks proceed to a cutting station in which the handle rip tape 57 is severed along line 59 between adjacent sacks. With the non-reclosable fastener in place, the sacks 50 are then ready to be filled with product and to have the bottom edges of the sack walls 51 sealed.

Although the method shown in FIG. 6 includes the application of the handle rip tape 57 and chain stitch 55 alone, a separate reel may be provided which includes a secondary reclosable fastener, such as the zipper-type fastener 18 of the embodiment of FIGS. 1–3, or the profile strip-type fastener 40 of the embodiment of FIG. 4. These particular secondary reclosable fasteners may be applied in the same manner described and illustrated in the Ferrell patent, U.S. Pat. No. 4,241,865, referenced and incorporated above.

Figure 7:
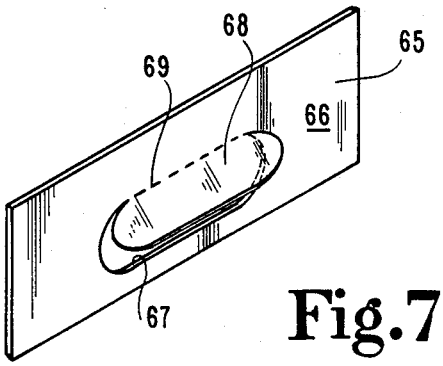
FIG. 7 is an enlarged perspective view of a detachable handle of the present invention.

The handle rip tape 57 is preferably formed in a continuous process in which a single strip of material is passed through a stamping operation to stamp the handle openings therethrough at spaced intervals coinciding with the spacing between adjacent sacks in the continuous process described above. The rip tape is preferably composed of a flexible plastic that can be die punched or stamped to form the handle cut-out opening and sewn onto the sack, yet remain sufficiently strong and tear resistant to allow its use as a carrying handle. In one version of the handle rip tape, a tape 65, shown in FIG. 7, includes an upper peripheral attachment portion 66 and a handle cut-out opening 67. The cut-out opening 67 is not completely closed, that is a flap 68 remains which is, in effect, hingedly attached to the remainder of the handle rip tape along line 69.

Other variations in the design and configuration of the handle cut-out opening 67 or in the handle rip tape 65 itself, are contemplated by the invention. For instance, the handle may be formed by an overlapped layer of plastic that is sealed along one edge to form a closed loop. The handle rip tape may also be formed of a strong crepe paper or cloth-type material that can be readily sewn and attached to a shipping sack by a chain stitch fastener, and that is sufficiently strong to carry the weight of a full shipping sack. The handle rip tape must also be sufficiently strong to avoid tearing when the handle rip tape is used to separate or unravel the chain stitch fastener.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A shipping sack having side walls defining a mouth through which the contents of the sack may be removed, comprising:

a non-reclosable stitched separable closure fastener across and closing the mouth of the sack and adapted for manual separation to remove said stitched fastener and open the mouth of the sack; and a rip tape for facilitating removal of said stitched fastener, said rip tape being removably joined to the sack by said stitched fastener and including;

an integral handle, said handle being manually graspable to carry the sack when said rip tape is joined to the sack; and a manually accessible integral free end, said free end being adapted to be manually pulled to remove said rip tape, whereby as said rip tape is removed said stitched fastener is separated from the shipping sack.

2. The shipping sack of claim 1, wherein said stitched fastener includes a chain stitch passing through said rip tape and through the side walls of the sack.

3. The shipping sack of claim 1, wherein said rip tape is a strip and said integral handle is defined by a cut-out opening in said strip.

4. The shipping sack of claim 3, wherein:

said strip is cut from a continuous strip; and said free end of said strip extends slightly beyond an edge of the side walls of the sack to facilitate manual access to said free end.

5. The shipping sack of claim 1, further comprising secondary reclosable closure means secured to the sack across the mouth of the sack outboard of and apart from said stitched fastener, for closing the mouth after opening of said stitched fastener.

* * * * *